US009157202B2

(12) United States Patent
Fukano et al.

(10) Patent No.: US 9,157,202 B2
(45) Date of Patent: Oct. 13, 2015

(54) SNOW PLOW

(71) Applicant: HONDA MOTOR CO., LTD., Tokyo (JP)

(72) Inventors: Jun Fukano, Wako (JP); Tsutomu Mizoroke, Wako (JP); Shinsaku Nakayama, Wako (JP)

( * ) Notice: Subject to any disclaimer, the term of this patent is extended or adjusted under 35 U.S.C. 154(b) by 0 days.

(21) Appl. No.: 14/518,044

(22) Filed: Oct. 20, 2014

(65) Prior Publication Data

US 2015/0107136 A1 Apr. 23, 2015

(30) Foreign Application Priority Data

Oct. 23, 2013 (JP) ..... 2013-220000

(51) Int. Cl.
*E01H 5/04* (2006.01)
*E01H 5/09* (2006.01)

(52) U.S. Cl.
CPC . *E01H 5/098* (2013.01); *E01H 5/04* (2013.01)

(58) Field of Classification Search
CPC .... A01B 33/028; A01B 33/082; A01B 51/02; E02F 9/2004; E01H 5/00; E01H 5/04; E01H 5/09; E01H 5/098; B62D 51/004; B62D 51/04; B60K 1/02; B60L 3/08; B60L 15/18; B60L 15/20; B60W 10/08
USPC ..... 37/234–236, 244, 245, 247, 249, 257, 37/347, 348; 318/61, 64, 66, 139, 567; 180/183, 19.2, 19.3, 68.2, 68.5; 701/22, 50, 70
See application file for complete search history.

(56) References Cited

U.S. PATENT DOCUMENTS 6,564,481 B2 * 5/2003 Wakitani et al. ..... 37/348
6,977,473 B2 * 12/2005 Wakitani et al. ..... 318/64
7,997,016 B2 * 8/2011 Yamazaki et al. ..... 37/234

FOREIGN PATENT DOCUMENTS

JP S63-136012 9/1988
JP 2007-032218 2/2007

* cited by examiner

*Primary Examiner* — Robert Pezzuto
(74) *Attorney, Agent, or Firm* — Rankin, Hill & Clark LLP

(57) ABSTRACT

A snow plow includes a control unit for raising an auger housing to a predetermined upper limit angle when travel device is reversing, and an acceleration sensor for detecting acceleration produced in the auger housing. The control unit determines an angle of inclination of the auger housing on the basis of the acceleration. When the travel device starts moving forward after having temporarily moved in reverse, the control unit sets an intermediate lowering target angle of inclination, which is in the lowering path of the auger housing from the upper limit angle to a pre-reversing angle of inclination, in accordance with the forward acceleration; lowers the auger housing at a given lowering speed from the upper limit angle to the intermediate lowering target angle of inclination; and lowers the auger housing at a gradually decreasing lowering speed from the intermediate lowering target angle of inclination to the pre-reversing angle of inclination.

1 Claim, 8 Drawing Sheets

SNOW PLOW

FIELD OF THE INVENTION

The present invention relates to a self-propelled snow plow having a travel device and an auger.

BACKGROUND OF THE INVENTION

In auger-type snow plows, an auger housing is mounted to a vehicle body frame including travel device, such that the auger housing can be raised and lowered and made to roll. The auger housing includes an auger. An auger snow plow can scrape up snow by means of a front auger while traveling forward, and can disperse the scraped up snow far away by means of a blower via a shooter.

A snow plow including an auger employs a system for varying the height of the auger housing in accordance with the conditions of the snow plowing work. It is more efficient to move the snow plow when the bottom surface of the auger housing has been raised. It is more efficient to plow snow when the bottom surface of the auger housing has been lowered. The height of the auger housing is also often varied according to unevenness in the road surface when snow is plowed.

It is highly inconvenient for a worker to make these variations to the height of the auger housing through manual labor. To alleviate the burden on the worker, the bottom surface of the auger housing can be raised and lowered with a power assist. This feature is disclosed in Japanese Utility Model Application Laid-Open Publication No. 63-136012 (JP-U S63-136012) and Japanese Patent Application Laid-Open Publication No. 2007-032218 (JP-A 2007-032218).

In the snow plow disclosed in JP-U S63-136012, the auger housing angle is used to control an angle of inclination detector provided to the auger housing to detect the angle of the auger housing relative to the direction of gravity.

In the snow plow disclosed in JP-A 2007-032218, the raised/lowered angle and the rolling angle of the auger housing are controlled by using a height position sensor to detect the raised/lowered position of the auger housing and using a rolling position sensor to detect the tilt position of the auger housing control.

When an auger snow plow is doing snow plowing work, it is common for the travel device to be temporarily put in reverse and then again be put in forward. When the travel device is put in reverse, the auger housing is preferably automatically raised to a certain height so as not to catch on the road surface. When the travel device is then again put in forward, the auger housing may be automatically lowered to the tilt angle immediately before the travel device was put in reverse, in which case considerations relating to work efficiency make it preferable to be able to stop the auger housing quickly and precisely at the original tilt angle.

A demand thus exists for a feature whereby the auger housing can be stopped quickly and precisely in the pre-reversing tilt angle position.

SUMMARY OF THE INVENTION

According to the present invention, there is provided a snow plow including a travel frame having travel device, an auger housing having an auger and capable of being raised and lowered relative to the travel frame, a raising/lowering drive mechanism for raising and lowering the auger housing, and a control unit for controlling the raising/lowering drive mechanism so as to raise the auger housing to a predetermined upper limit angle when the travel device is reversing, wherein the snow plow includes an acceleration sensor for detecting acceleration produced in the auger housing, the control unit determines an angle of inclination of the auger housing on the basis of the acceleration detected by the acceleration sensor, and when a condition is satisfied that the travel device starts moving forward after having temporarily moved in reverse the control unit sets an intermediate lowering target angle of inclination, which is in the lowering path of the auger housing from the upper limit angle to a pre-reversing angle of inclination, in accordance with the forward acceleration; controls the raising/lowering drive mechanism so that the auger housing is lowered at a given lowering speed from the upper limit angle to the intermediate lowering target angle of inclination; and controls the raising/lowering drive mechanism so that the auger housing is lowered at a gradually decreasing lowering speed from the intermediate lowering target angle of inclination to the pre-reversing angle of inclination.

Thus, the intermediate lowering target angle of inclination is set as an addition to the pre-reversing angle of inclination. Moreover, using the intermediate lowering target angle of inclination as a reference, the speed at which the auger housing is lowered differs between angles greater than and less than this reference. In other words, when the auger housing is above the intermediate lowering target angle of inclination, the auger housing can quickly lower to the intermediate lowering target angle of inclination by lowering at the given lowering speed. When the auger housing is thereafter below the intermediate lowering target angle of inclination, the lowering speed is gradually reduced. As a result, the auger housing can be stopped with precision at the position of the pre-reversing angle of inclination.

Moreover, the intermediate lowering target angle of inclination is determined from the value of the forward acceleration. A higher forward travel speed of the travel device corresponds to a greater increase in the acceleration of the auger housing. In addressing such circumstances, an increase in acceleration corresponds to a larger additional angle relative to the position of the pre-reversing angle of inclination. As a result, it is possible to prevent the auger housing from going below the pre-reversing angle of inclination due to the effect of its own acceleration.

Thus, the auger housing can be stopped quickly and precisely at the position of the pre-reversing angle of inclination while the effect of the acceleration of the auger housing as derived from the forward travel speed of the travel device is minimized.

BRIEF DESCRIPTION OF THE DRAWINGS

Preferred embodiments of the present invention will be described in detail below with reference to the accompanying drawings, in which.

DETAILED DESCRIPTION OF THE PREFERRED EMBODIMENTS

Figure 1:
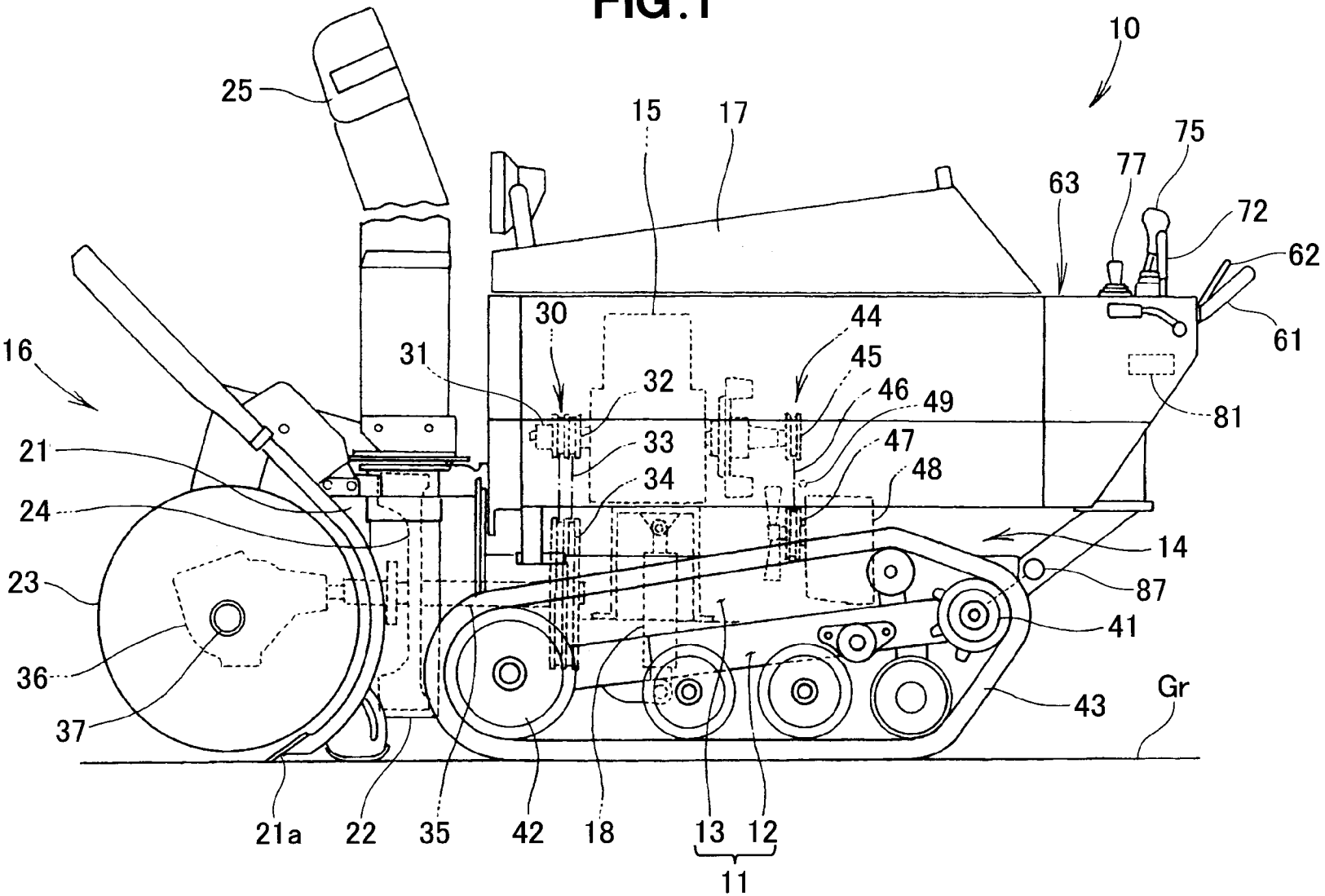
FIG. 1 is a side view of the snow plow relating to the present invention.

As shown in FIG. 1, a snow plow 10 is a self-propelled work machine in which an auger 23 and a blower 24 for dispersing snow gathered by the auger 23 peripherally outward from a shooter 25 are driven by an engine 15, the snow plow 10 being self-propelled by means of travel device 14. The engine 15 is covered by an engine cover 17.

Specifically, a chassis 11 of the snow plow 10 comprises a travel frame 12 and a vehicle body frame 13. The travel frame 12 includes the travel device 14. The vehicle body frame 13 includes the engine 15 and a snow-plowing implement 16. The rear part of the vehicle body frame 13 is mounted to the travel frame 12 so as to be able to swing up and down. The front part of the vehicle body frame 13 is driven by a raising/lowering drive mechanism 18 so as to be raised and lowered (swung up and down).

Figure 2:
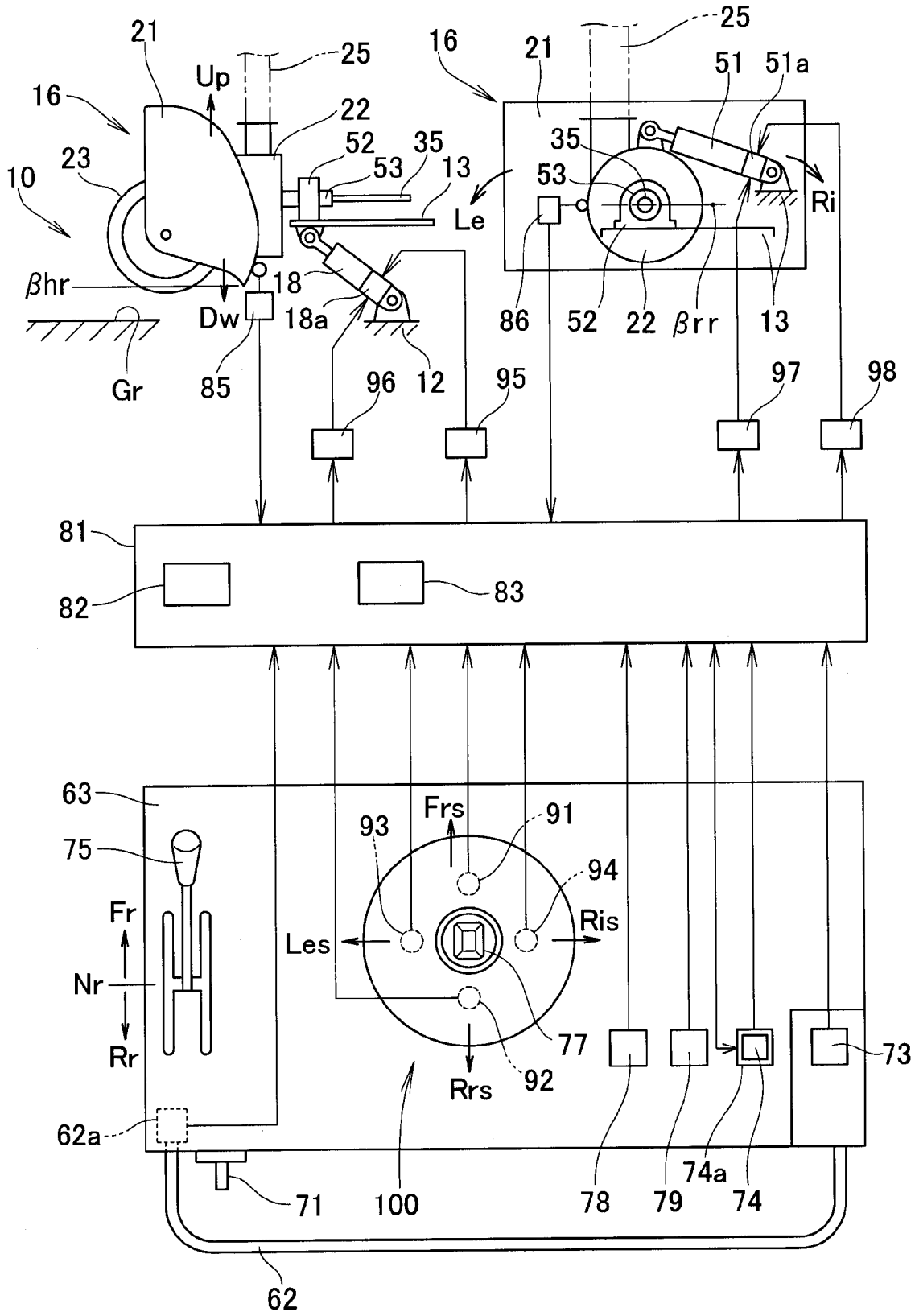
FIG. 2 is a schematic view of the relationship between the operation unit and the snow-plowing implement shown in FIG. 1.

As shown in FIG. 2, the raising/lowering drive mechanism 18 is an actuator in which a piston can extend from and withdraw into a cylinder. For example, the actuator is a type of electro-hydraulic cylinder in which a hydraulic pump (not shown) is driven by an electric motor 18*a*, whereby a piston is extended and retracted by the hydraulic pressure produced by the hydraulic pump. The electric motor 18*a* is a raising/lowering drive source incorporated integrally into a side part of the cylinder of the raising/lowering drive mechanism 18.

One end of the raising/lowering drive mechanism 18 is mounted to the travel frame 12 so as to be able to swing up and down. The other end of the raising/lowering drive mechanism 18 is mounted to the vehicle body frame 13 so as to be able to swing up and down. The vehicle body frame 13, an auger housing 21, and a blower case 22 can be raised and lowered (swung up and down) by the raising/lowering drive mechanism 18.

As shown in FIG. 1, the snow-plowing implement 16 comprises an auger housing 21, a blower case 22 integrated with the back surface of the auger housing 21, an auger 23 included in the auger housing 21, a blower 24 included in the blower case 22, and a shooter 25. The auger housing 21 includes a scraper 21*a* at the rear lower end.

The motive power of the engine 15 is transmitted to the snow-plowing implement 16 by a power transmission system 30. The power transmission system 30 comprises an auger clutch 31, a drive pulley 32, a belt 33, and a driven pulley 34. When the auger clutch 31 is activated, the motive power of the engine 15 is transmitted sequentially to the drive pulley 32, the belt 33, the driven pulley 34, a rotating shaft 35, a gear mechanism inside a gear case 36, an auger shaft 37, the auger 23, and the blower 24. The auger 23, which is caused to rotate by this power, scrapes up snow on the ground into the widthwise center of the auger, and feeds the snow to the blower 24. The blower 24 projects the snow through the shooter 25 through centrifugal force.

The auger clutch 31 is configured from a conventional electric clutch mechanism; e.g. an electromagnetic clutch or a motor-driven belt tensioning mechanism. When the auger clutch 31 is configured from an electromagnetic clutch, the auger clutch 31 is provided so as to be capable of coupling the drive pulley 32 and an output shaft of the engine 15. When configured from a conventional motor-driven belt tensioning mechanism, the auger clutch 31 comprises a tensioner capable of applying tension to the belt 33, and a motor for driving the tensioner.

The travel device 14 is configured from a crawler of which the basic elements are a drive wheel 41, an idler wheel 42, and a crawler belt 43. The motive power of the engine 15 is transmitted to the travel device 14 by a travel power transmission system 44.

The travel power transmission system 44 comprises a drive pulley 45 mounted on the output shaft of the engine 15, a belt 46, a driven pulley 47, a hydraulic CVT (CVT) 48, and a belt tensioning mechanism 49. The hydraulic CVT 48 is capable of forward and reverse rotation as well as continuously variable gear shifting. An output shaft of the hydraulic CVT 48 is coupled to the drive wheel 41. The motive power of the engine 15 is transmitted sequentially to the drive pulley 45, the belt 46, the driven pulley 47, the hydraulic CVT 48, the drive wheel 41, and the crawler belt 43, whereby the crawler belt 43 can be rotated and made to travel over a road.

The rotating direction and rotational speed of the drive wheel 41 are detected by a rotation sensor 87. The rotation sensor 87 either detects the rotating direction and rotational speed of one of the rotating shafts within the hydraulic CVT 48, or directly detects the rotating direction and rotational speed of the drive wheel 41.

The belt tensioning mechanism 49 of the travel power transmission system 44, which has a conventional configuration, is configured from a tensioner (not shown) capable of applying tension to the belt 46. The tensioner is coupled to a travel preparatory lever 62 by a wire cable (not shown). Grasping the travel preparatory lever 62 allows the tensioner to be operated to apply tension to the belt 46. As a result, the motive power of the engine 15 can be transmitted from the drive pulley 45 to the driven pulley 47 by the belt 46.

The snow plow 10 is configured such that the auger housing 21 and the blower case 22 are rollably mounted to the vehicle body frame 13, and the auger housing 21 and the blower case 22 are rolled by a rolling drive mechanism 51 (see FIG. 2).

To give a more detailed description, as shown in FIG. 2, a rotating support part 53 is supported on the front end of the vehicle body frame 13 by a bearing 52 so as to be capable of rotating left and right. The rear end of the blower case 22 is secured to the rotating support part 53. Furthermore, the rotating support part 53 supports the rotating shaft 35, which extends longitudinally with respect to the blower case 22, the rotating shaft 35 being supported so as to be capable of rotating left and right. As a result, the auger housing 21 and the blower case 22 are mounted to the vehicle body frame 13 so as to be capable of rotating left and right (rolling) about the rotating shaft 35.

As described above, the travel frame 12 has a configuration including the mounted vehicle body frame 13. Therefore, the auger housing 21 and the blower case 22 are rollably mounted to the travel frame 12. As a result, the auger housing 21 is capable of rising, falling, and rolling relative to the travel frame 12.

The rolling drive mechanism 51 is an actuator in which a piston can extend from and withdraw into a cylinder. For example, the actuator is a type of electro-hydraulic cylinder in which a hydraulic pump (not shown) is driven by an electric motor 51*a*, and a piston is thereby extended and retracted by the hydraulic pressure produced by the hydraulic pump. The electric motor 51*a* is a rolling drive source incorporated integrally into a side of the cylinder of the cylinder of the rolling drive mechanism 51.

One end of the rolling drive mechanism 51 is mounted to the vehicle body frame 13 so as to be capable of swinging left and right. The other end of the rolling drive mechanism 51 is mounted to the back surface of the blower case 22 so as to be capable of swinging left and right. The auger housing 21 and the blower case 22 can be rolled by the rolling drive mechanism 51.

Figure 3:
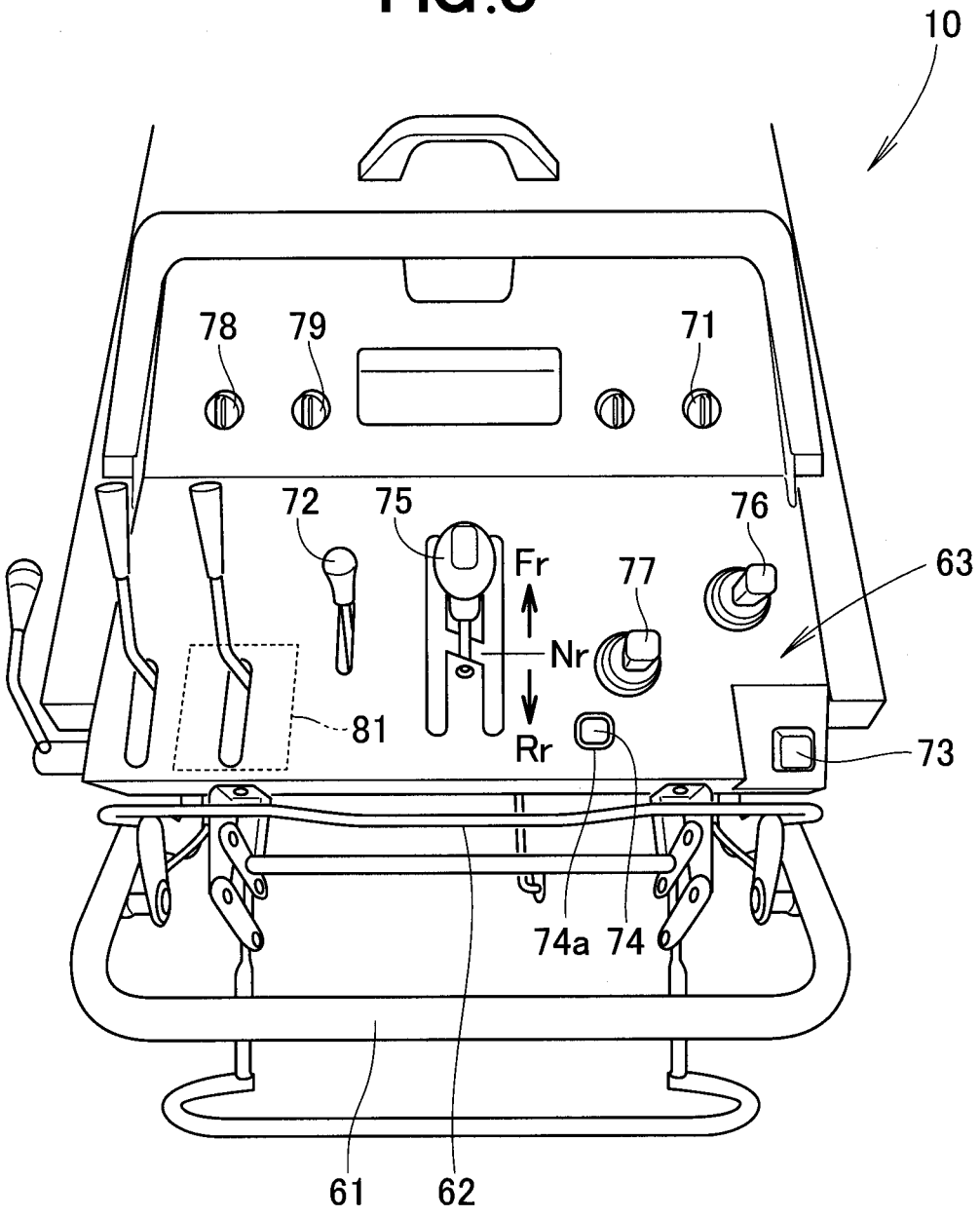
FIG. 3 is a perspective view from the rear and above of the operation unit shown in FIG. 1.

As shown in FIGS. 1 and 3, an operating handle 61, the travel preparatory lever 62, and an operating unit 63 are provided to the back part of the vehicle body frame 13. The operating handle 61 is a handle that is positioned on the rear part of the operating unit 63 and is substantially U-shaped in plan view. A worker can operate the snow plow 10 by means of the operating handle 61 while walking behind the snow plow 10.

The travel preparatory lever 62 is an operating member that is positioned along the operating handle 61 on the rear part of the operating unit 63 and is substantially U-shaped in plan view, the lever being mounted to the vehicle body frame 13 so as to be capable of swinging up and down. The travel preparatory lever 62, known as a "dead man's lever," is normally in a free state due to the urging force of a return spring, and when this lever is gripped together with the operating handle 61 by a worker, a clutch lever switch 62*a* (see FIG. 2) can be turned on. When the clutch lever switch 62*a* is on, the auger clutch 31 (see FIG. 1) is turned on by turning on an auger switch 73.

Furthermore, the belt tensioning mechanism 49 can be operated via the wire cable by grasping the travel preparatory lever 62 and the operating handle 61 together, to apply tension to the belt 46. As a result, the motive power of the engine 15 can be transmitted from the drive pulley 45 to the driven pulley 47 by the belt 46.

As shown in FIGS. 2 and 3, the operating unit 63 includes a main switch 71, a throttle lever 72, the auger switch 73, a reset switch 74, a reset display light 74*a*, a directional speed lever 75, a shooter operation lever 76, an auger housing lever 77, an auto height switch 78, and an auger assist switch 79.

The main switch 71 is a manual switch capable of starting up the engine 15 (see FIG. 1) by being turned on and stopping the engine 15 by being turned off, and is, for example, a rotary switch. The throttle lever 72 is an operating member for controlling the speed of the engine 15.

The auger switch 73 (also referred to as the "clutch operation switch 73") is a manual switch for shifting the auger clutch 31 (see FIG. 1) between on and off, and comprises, e.g., a push-button switch. When the clutch lever switch 62*a* is turned on by grasping the travel preparatory lever 62, the auger clutch 31 is turned on by operating the auger switch 73, and the auger 23 and the blower 24 can be rotated by the motive power of the engine 15 shown in FIG. 1.

When the auger clutch 31 is configured from a motor-driven belt tensioning mechanism, the tensioner driven by the forward rotation of the motor applies tension to the belt 33. The auger clutch 31 can be turned off either by releasing the travel preparatory lever 62 or by operating the auger switch 73. When the auger clutch 31 is configured from a motor-driven belt tensioning mechanism, reverse rotation of the motor causes the tensioner to release the tension on the belt 33.

The reset switch 74 (also referred to as the "original auger position auto-return switch 74") is a manual switch for returning the orientation (position) of the auger housing 21 to the original point which has been set in advance. A push button switch, for example, is used as the reset switch 74. The reset switch 74 is an "automatic return switch," which is turned on by the push button being pushed by a hand, and turned off by the hand being withdrawn and the push button being automatically returned by a return spring to the position prior to being pushed. The reset display light 74*a* illuminates in conjunction with the reset switch 74 turning on, and extinguishes when the auger assist switch 79 turns off, for example.

The directional speed lever 75 (also referred to as the "forward-backward travel speed adjustment lever 75") is an operating member for adjusting the traveling state of the snow plow 10 by being reciprocatingly operated by hand. The directional speed lever 75 can be swingingly operated forward and backward from a stop position Nr where the lever stands upright in the middle, forward to a forward Fr side and backward to a reverse Rr side. The directional speed lever 75 is coupled to a gear shift lever of the hydraulic CVT 48 (see FIG. 1) by a coupling mechanism such as a link mechanism or a wire cable. The rotating direction and rotational speed of the output shaft of the hydraulic CVT 48 are varied by adjusting the hydraulic CVT 48 by means of the directional speed lever 75.

Thus, the directional speed lever 75 is an operating member for adjusting the traveling state of the snow plow 10, i.e. the forward speed or the reverse speed. In other words, the directional speed lever 75 is an operating member for operating the traveling speed of the travel device 14 (see FIG. 1).

When the directional speed lever 75 is positioned in the stop position Nr, the hydraulic CVT 48 is in a neutral state and output to the travel device 14 remains at zero. The travel device 14 is therefore stopped. The rotation sensor 87 (see FIG. 1) detects that the travel device 14 has stopped because the hydraulic CVT 48 is in a neutral state.

When the directional speed lever 75 is swung from the stop position Nr to the forward Fr side, the hydraulic CVT 48 transmits to the travel device 14 forward-directional output at a speed according to the swing angle of the directional speed lever 75. As a result, the travel device 14 moves forward. The rotation sensor 87 detects that the travel device 14 is rotating in the forward direction.

When the directional speed lever 75 is swung from the stop position Nr to the reverse Rr side, the hydraulic CVT 48 transmits to the travel device 14 reverse-directional output at a speed according to the swing angle of the directional speed lever 75. As a result, the travel device 14 moves in reverse. The rotation sensor 87 detects that the travel device 14 is rotating in the reverse direction.

The shooter operation lever 76 is an operating member for varying the left-right orientation of the shooter 25 (see FIG. 1). The up-down direction of the top part of the shooter 25 can be adjusted by the shooter operation lever 76 to adjust the blown direction of the scraped up snow.

The auger housing lever 77 (an auger housing orientation operation lever 77) is an operating member for varying the orientation of the auger housing 21. In other words, the auger housing lever 77 is an operating member for operating the raising/lowering drive mechanism 18 and the rolling drive mechanism 51 for the purpose of raising, lowering, and rolling the auger housing 21 in line with the snow surface during snow blowing work with the auger 23.

The auto height switch 78 is a manual switch shifted between on and off in order for a control unit 81 to execute control of an auto height-up mode and an auto height-down mode, and this switch comprises, e.g., a rotary switch.

Figure 9A:
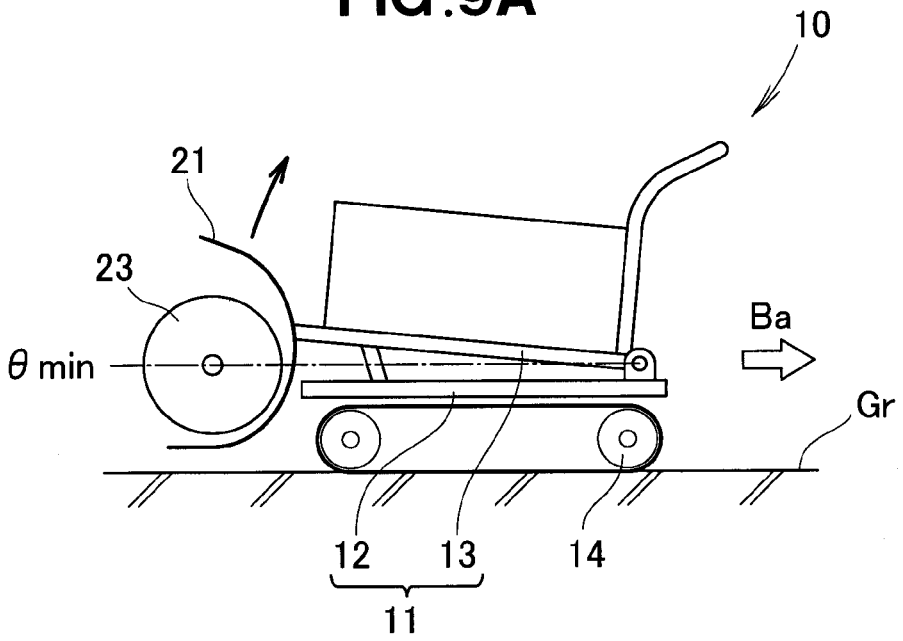
FIGS. 9A and 9B illustrate the relationship between the behavior of the travel device shown in FIG. 1 and the height action of the auger housing.
Figure 9B:
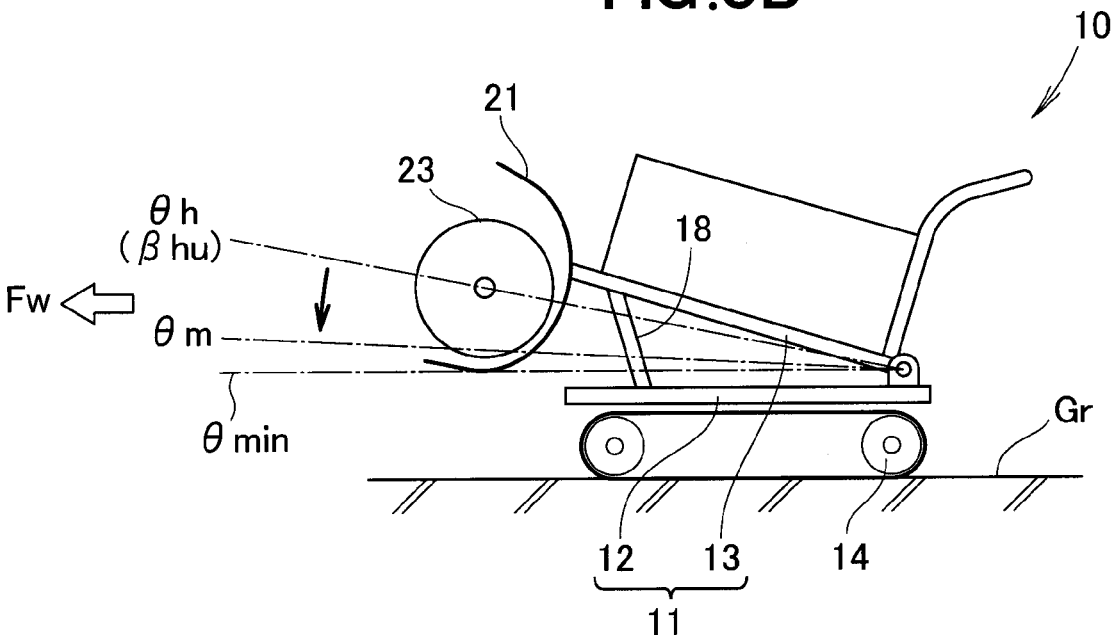

As shown in FIGS. 9A and 9B, the auto height-up mode is a control mode for controlling the raising/lowering drive mechanism 18 so that the auger housing 21 is automatically raised to a predetermined upper limit angle βhu when the travel device 14 is in reverse. If the auto height-up mode is enabled, the auger housing 21 can be prevented from catching on the snow surface when the travel device 14 is in reverse.

The auto height-down mode is a control mode for controlling the raising/lowering drive mechanism 18 so that the auger housing 21 is automatically returned to the same pre-reversing height; i.e. to the original height, when the auger 23 is rotating and the travel device 14 again moves forward.

In the auto height-up mode and the auto height-down mode, an angle of inclination βhr detected by a height position sensor 85 shown in FIG. 2 is employed as the current height of the auger housing 21.

The auger assist switch 79 shown in FIG. 3 is a manual switch shifted between on and off in order for the control unit 81 to execute control of an assist mode, the switch comprising, e.g., a rotary switch. In the assist mode, an angle of inclination θh based on an acceleration αh detected by an acceleration sensor 83 shown in FIG. 2 is employed as the current height of the auger housing 21.

The assist mode is a control mode for controlling the raising/lowering drive mechanism 18 when control of the auto height-down mode is executed so that, as shown in FIGS. 9A and 9B, if the current angle of inclination θh is far from the height θmin of the auger housing 21 immediately before the reversing, the mechanism is lowered at a high speed, and if the angle of inclination θh is near the height θmin, the mechanism is lowered at a low speed. This series of actions is performed by the control unit 81 (see FIG. 2) executing the steps S21, S22, and S24 shown in FIG. 4.

Next, the control system of the snow plow 10 is described.

As shown in FIG. 2, the control system of the snow plow 10 is focused around the control unit 81. The control unit 81 houses a memory 82, and the control unit is configured to appropriately read and control various pieces of information stored in the memory 82.

Furthermore, the control unit 81 houses the acceleration sensor 83 for detecting the acceleration produced in the auger housing 21. The acceleration sensor 83 is integrated on a substrate together with other electronic circuitry and the like of the control unit 81, for example. As described above, the auger housing 21 and the operating unit 63 are provided to the vehicle body frame 13. The control unit 81 is provided inside the operating unit 63. Therefore, the orientation of the acceleration sensor 83 can be varied together with the auger housing 21. In other words, the acceleration sensor 83 has substantially the same configuration as when it is provided directly to the auger housing 21, and the sensor is capable of detecting acceleration produced in the auger housing 21.

The acceleration sensor 83 comprises a triaxial acceleration sensor capable of detecting acceleration in the directions of three axes: an x-axis, a y-axis, and a z-axis. The triaxial acceleration sensor may be a common "semiconductor acceleration" sensor. Types of semiconductor acceleration sensors include piezo resiorientation sensors, static capacitance sensors, and heat-detecting sensors, for example.

Such triaxial acceleration sensors are capable of detecting acceleration in the directions of three axes produced in the auger housing 21. Acceleration in the x-axis direction, for example, is vertical linear acceleration; i.e. acceleration in the direction of gravity (gravitational acceleration) produced in the auger housing 21. Acceleration in the y-axis direction is acceleration in the left-right horizontal direction, produced in the auger housing 21. Acceleration in the z-axis direction is acceleration in the forward-backward horizontal direction, produced in the auger housing 21.

Acceleration produced in the auger housing 21 is detected by the acceleration sensor 83 and the angle of inclination of the auger housing 21 can be determined based on the detection value. This acceleration sensor can therefore be regarded to be a frame inclination angle detection unit in the present invention.

Next, the relationship between the snow-plowing implement 16 and the auger housing lever 77 is described in detail based on FIG. 2.

A housing orientation operating unit 100 is configured from the auger housing lever 77 and four switches 91 to 94 for operating the orientation of the auger housing. Electric power can be supplied to the electric motors 18*a*, 51*a* by swinging the auger housing lever 77 and turning on switch elements 95 to 98 individually. The switch elements 95 to 98 are configured from field effect transistors (FET), for example.

When the auger housing lever 77 is swung to the front side Frs, a lowering switch 91 turns on. The control unit 81, having received an on signal, supplies electric power to the electric motor 18*a* to cause forward rotation by turning on a lowering switch element 95. The raising/lowering drive mechanism 18 thereby lowers the auger housing 21 and the blower case 22 (displaces them in the direction of the arrow Dw).

When the auger housing lever 77 is swung to the rear side Rrs, a raising switch 92 turns on. The control unit 81, having received an on signal, supplies electric power to the electric motor 18*a* to cause backward rotation by turning on a raising switch element 96. The raising/lowering drive mechanism 18 thereby raises the auger housing 21 and the blower case 22 (displaces them in the direction of the arrow Up).

When the auger housing lever 77 is swung to the left side Les, a left-rolling switch 93 turns on. The control unit 81, having received an on signal, supplies electric power to the electric motor 51*a* to cause forward rotation by turning on a left-rolling switch element 97. The rolling drive mechanism 51 thereby tilts (rolls) the auger housing 21 and the blower case 22 to the left Le.

When the auger housing lever 77 is swung to the right side Ris, a right-rolling switch 94 turns on. The control unit 81, having received an on signal, supplies electric power to the electric motor 51*a* to cause backward rotation by turning on a right-rolling switch element 98. The rolling drive mechanism 51 thereby tilts (rolls) the auger housing 21 and the blower case 22 to the right Ri.

Thus, swinging the auger housing lever 77 forward and backward causes the electric motor 18*a* to rotate forward and backward and the piston of the raising/lowering drive mechanism 18 to extend and retract. As a result, the auger housing 21 and the blower case 22 rise and fall. The vertical position of the auger housing 21 is detected by the height position sensor 85, and a detection signal produced thereby is sent to the control unit 81.

Similarly, swinging the auger housing lever 77 to the left and right causes the electric motor 51*a* to rotate forward and backward and the piston of the rolling drive mechanism 51 to extend and retract. As a result, the auger housing 21 and the blower case 22 roll to the left and right. The rolling position of the auger housing 21 is detected by a rolling position sensor 86, and a detection signal thereof is sent to the control unit 81.

The height position sensor 85 (first housing inclination angle detection unit 85), which detects the relative angle of inclination βhr of the auger housing 21 in the vertical direction (the height direction) in relation to the travel frame 12, is configured from a waterproof rotary potentiometer, for example. The height position sensor 85 is mounted on the vehicle body frame 13.

The rolling position sensor 86 (second housing inclination angle detection unit 86), which detects the relative angle of inclination βrr of the auger housing 21 in the left-right direction in relation to the vehicle body frame 13, is configured from a waterproof rotary potentiometer, for example. The rolling position sensor 86 is mounted on the front end of the vehicle body frame 13. Accordingly, the vehicle body frame 13 does not become relatively inclined in the left-right direction in relation to the travel frame 12. Therefore, the rolling position sensor 86 detects the relative angle of inclination of the auger housing 21 in the left-right direction in relation to the travel frame 12.

Figure 4:
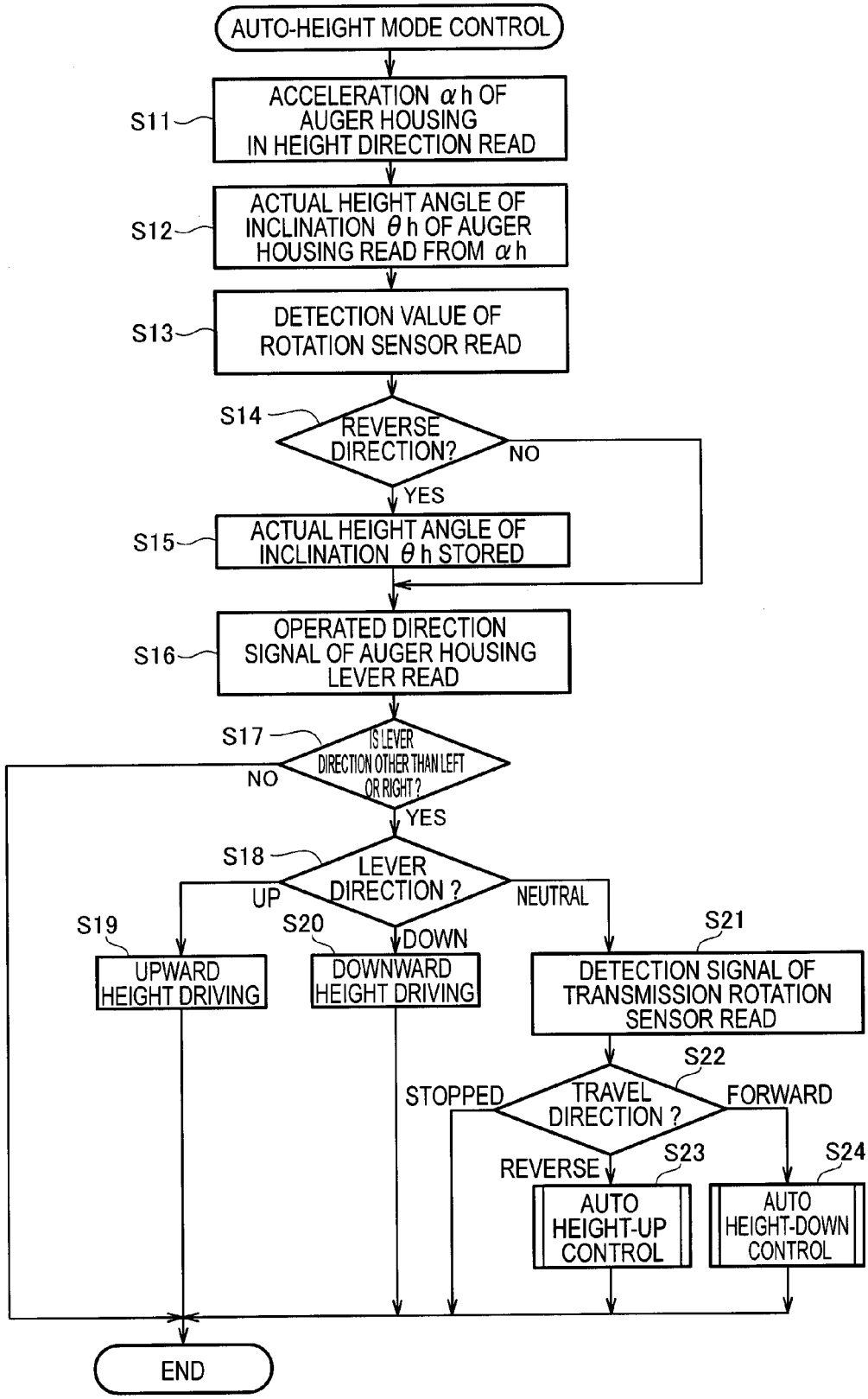
FIG. 4 is a control flowchart of the control unit shown in FIG. 2.
Figure 5:
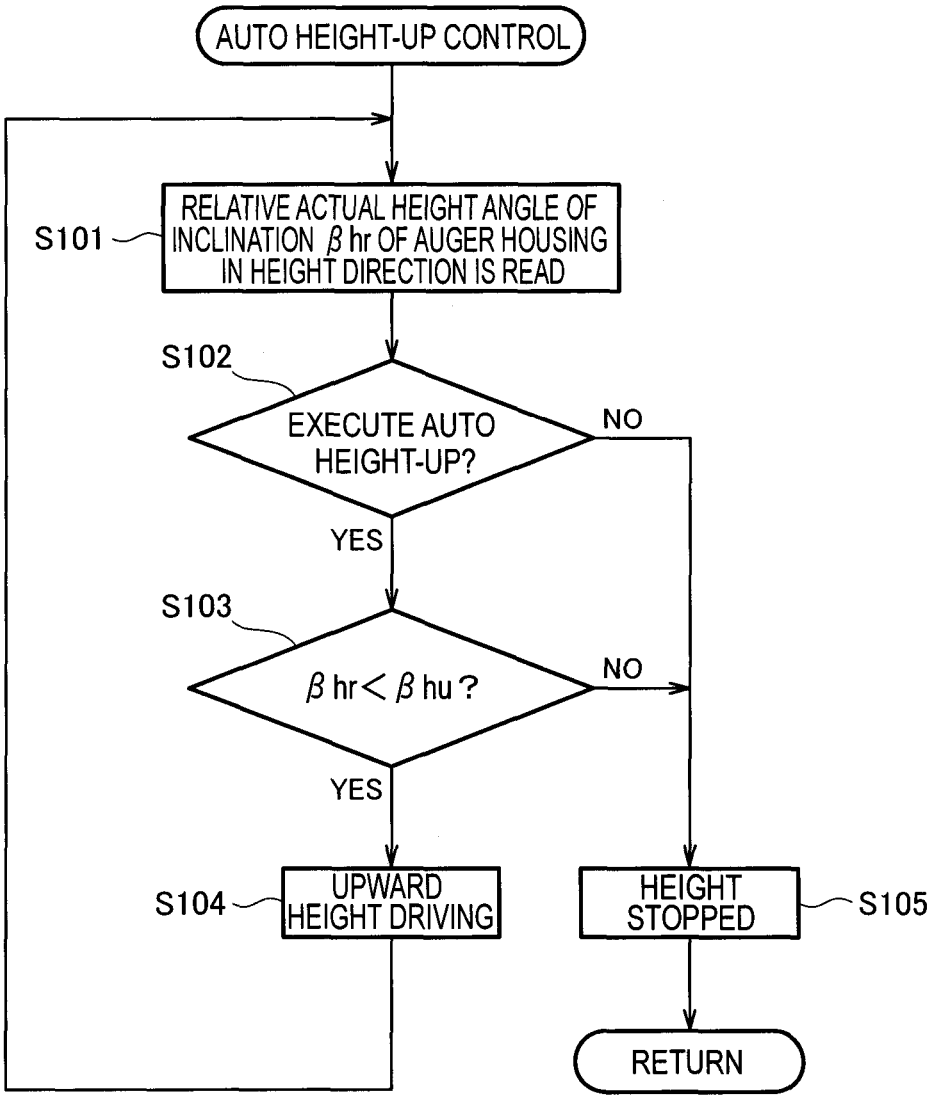
FIG. 5 is a specific control flowchart of the auto height-up control shown in FIG. 4.
Figure 6:
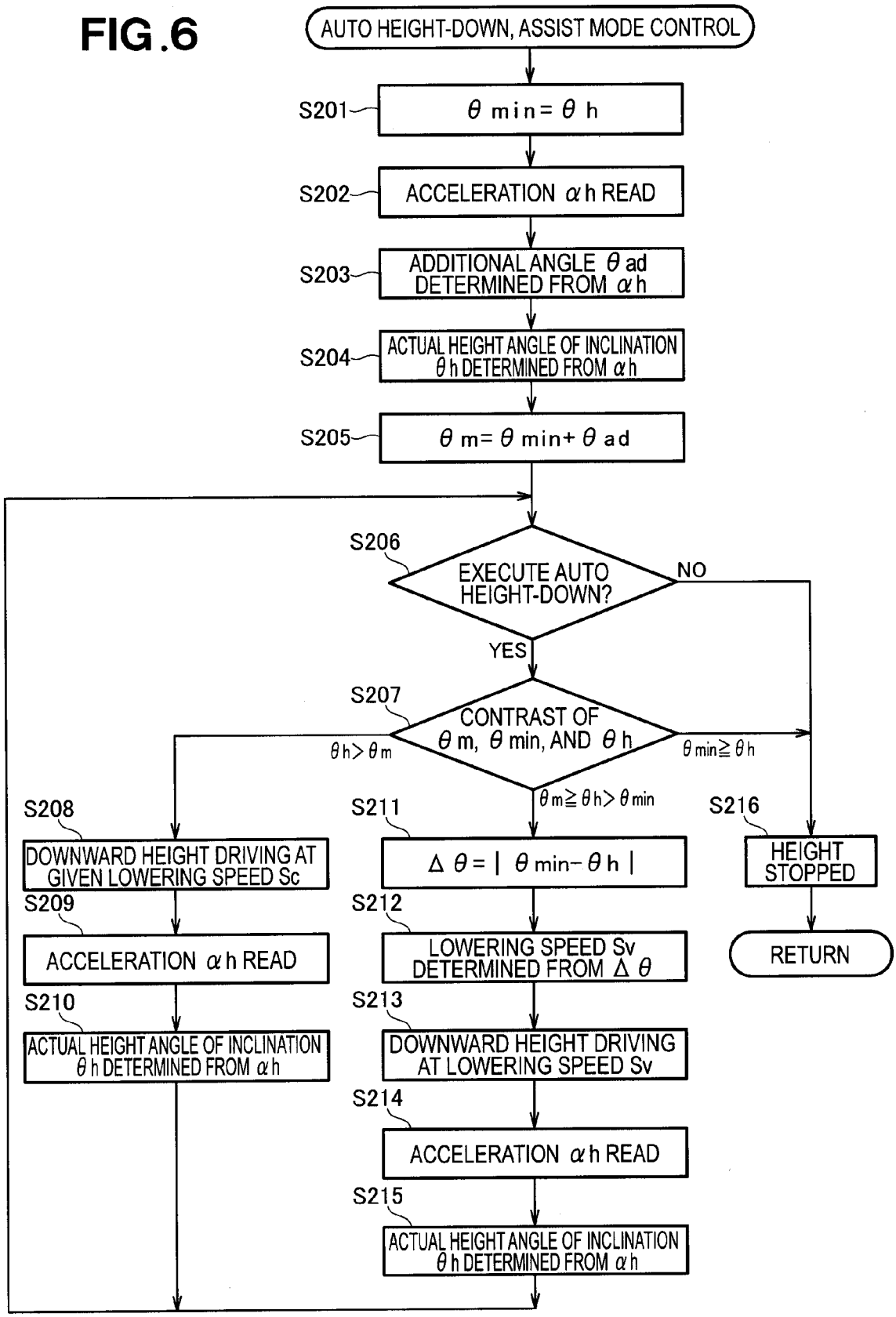
FIG. 6 is a specific control flowchart of the auto height-down control shown in FIG. 4.

Next is a description, based on FIGS. 4 to 6, of the control flow when the control unit 81 (see FIG. 2) is configured from a microcomputer.

In this control flow, control is started when the following five conditions are all satisfied, for example. The first condition is that the main switch 71 be on. The second condition is that the clutch lever switch 62*a* be on (that the travel preparatory lever 62 be gripped). The third condition is that the auger clutch 31 be on (that the auger 23 be rotating). The fourth condition is that the auto height switch 78 be on. The fifth condition is that the auger assist switch 79 be on.

In the control flowchart shown in FIGS. 4 to 6, the only steps of controlling the snow plow 10 that will be described are those pertaining to the auto height of the auger housing 21 and assist mode control, steps pertaining to other controls being omitted. The description below refers to FIGS. 2 and 3.

FIG. 4 is a control flowchart of the control unit 81 relating to the present invention. When the control unit 81 starts to perform a control, first, acceleration βh of the auger housing 21 in the height direction is read (step S11). For the height-direction acceleration αh (actual acceleration βh), a detection value detected by the acceleration sensor 83 is preferably read.

Next, the angle of inclination θh of the auger housing 21 in the height direction is determined from the acceleration αh (step S12). The angle of inclination θh is the actual height angle of inclination of the auger housing 21 in relation to the direction of gravity (the axis in the direction of gravity). The method of determining the angle of inclination θh in the height direction (referred to below as the actual height angle of inclination θh) on the basis of the acceleration αh is preferably a method that does so using common computation formulae or a map, for example. When a map is employed, the relationship of the actual height angle of inclination θh to the acceleration αh is set in advance and stored in the memory 82.

In step S12, it is preferable to have a filter function for slowly changing the value of the acceleration αh when the snow plow 10 is accelerating, decelerating, or turning. Whether the snow plow 10 is accelerating, decelerating, or turning is assessed according to the rate of change per unit time of a detection signal of the rotation sensor 87. Furthermore, in step S12, the value of the actual height angle of inclination θh is preferably corrected using a reference value corrected (zero point corrected) for individual snow plows 10 prior to shipping from a production factory. This reference value is stored in the memory 82.

Next, in step S13, the detection signal of the rotation sensor 87 is read. Next, in step S14, whether or not the direction in which the directional speed lever 75 is operated is the reverse direction is assessed based on the detection value of the rotation sensor 87. When it is assessed to be the reverse direction, the value of the actual height angle of inclination θh is stored in the memory 82 in step S15, after which the flow advances to step S16. When it is assessed to not be the reverse direction, the flow advances directly to step S16.

In step S16, switch signals are read from the four switches 91 to 94 of the housing orientation operating unit 100 shown in FIG. 2. The direction in which the auger housing lever 77 is operated is understood from these switch signals.

Next, an assessment is made as to whether or not the direction in which the auger housing lever 77 is operated is a direction other than left or right (step S17). When the direction in which the auger housing lever 77 is operated is assessed to be the left side Les or the right side Ris, the auger housing 21 and the blower case 22 are rolled to the left Le or the right Ri.

When the direction in which the auger housing lever 77 is operated is assessed to be a direction other than left or right in step S17, an assessment is made as to whether the direction in which the auger housing lever 77 is operated is up, down, or neutral (step S18). When the direction in which the auger housing lever 77 is operated is assessed to be the top side Frs, the flow advances to step S19, and the auger housing 21 and the blower case 22 are tilted upward Up (driven upward in height) by the raising/lowering drive mechanism 18.

When the direction in which the auger housing lever 77 is operated is assessed to be the bottom side Rrs in step S18, the flow advances to step S20. In step S20, the auger housing 21 and the blower case 22 are tilted downward Dw (driven downward in height) by the raising/lowering drive mechanism 18.

When the assessment in step S17 is NO, or after the process of step S19 or step S20 is complete, the control unit 81 ends the series of controls.

When the direction in which the auger housing lever 77 is operated is assessed to be neutral in the above-described step S18, the flow advances to step S21. In step S21, a detection signal of the rotation sensor 87 (see FIG. 1) is read.

In the next step S22, the direction in which the directional speed lever 75 is operated is assessed based on the detection signal of the rotation sensor 87. If the direction in which the directional speed lever 75 is operated is the neutral position, stop control is assessed as being in effect, and the series of controls is ended.

If the direction in which the directional speed lever 75 is operated is the reverse direction, reverse travel control is assessed as being in effect, the flow advances to step S23, and auto height-up control is executed, after which the series of controls is ended.

If the direction in which the directional speed lever 75 is operated is the forward direction, forward travel control is the assessment, the flow advances to step S24, and auto height-down control is executed, after which the series of controls is ended. In other words, when the condition is satisfied in step S22 that at least the travel device 14 have started moving forward after having temporarily reversed, the flow advances to step S24 and auto height-down control is executed.

A specific control flow for executing the auto height-up control process of step S23 is described with reference to FIG. 5. A specific control flow for executing the auto height-down control process of step S24 is described with reference to FIG. 6.

Next, the specific control flow for executing the auto height-up control process is described. FIG. 5 is a subroutine whereby the control unit 81 executes the "auto height-up control" of step S23 shown in FIG. 4 described above.

In the auto height-up control, height direction control of the auger housing 21 is executed according to the angle of inclination βhr detected by the height position sensor 85. First, the control unit 81 reads the relative angle of inclination βhr of the auger housing 21 in the height direction (the actual height inclination angle βhr at the current point in time) in relation to the travel frame 12 (step S101). To read the angle of inclination βhr, a detection signal of the height position sensor 85 is preferably read.

Next, in step S102, an assessment is made of whether or not to execute auto height-up control. Specifically, an assessment to execute auto height-up control is made when the following three conditions are all satisfied. The first condition is that the main switch 71 be on. The second condition is that the clutch lever switch 62*a* be on (that the travel preparatory lever 62 be gripped). The third condition is that the auto height switch 78 be on.

When the assessment is to not execute this control in step S102, the electric motor 18*a* is stopped and the rising of the auger housing 21 is stopped (step S105) by turning off the raising switch element 96, after which the subroutine is ended and the flow advances to step S23 shown in FIG. 4 described above. When the assessment is to execute the control in step S102, the flow advances to step S103.

In step S103, an assessment is made as to whether or not the actual height angle of inclination βhr at the current point in time is less than the reversing height upper limit angle βhu. The reversing height upper limit angle βhu (the upper limit value βhu of the height angle of inclination) is set to a predetermined upper limit angle set in advance, such that the bottom end of the auger housing 21 does not drag over the ground surface Gr when the travel device 14 is reversing.

When the assessment in step S103 is that βhr is less than βhu, the raising switch element 96 is turned on, causing electric power to be supplied to the electric motor 18*a* and backward rotation to be performed (step S104), after which the flow returns to step S101. The raising/lowering drive mechanism 18 thereby raises the auger housing 21 and the blower case 22. This upward Up driving is continued until it is assessed in step S103 that the actual height angle of inclination βhr has risen to the reversing height upper limit angle βhu.

When it is assessed in step S103 that the actual height angle of inclination βhr at the current point in time has risen to the reversing height upper limit angle βhu, the raising switch element 96 is turned off, causing the electric motor 18*a* to stop and the rising of the auger housing 21 to stop (step S105), after which the subroutine is ended and the flow advances to step S23 shown in FIG. 4 described above.

Next, the control flow for executing the auto height-down control process will be described in detail. FIG. 6 is a subroutine whereby the control unit 81 executes the "auto height-down control" of step S24 shown in FIG. 4 described above.

In the auto height-down control, height direction control of the auger housing 21 is executed according to the height angle of inclination θh determined from the acceleration αh. First, the control unit 81 sets the value of the pre-reversing actual height angle of inclination θh to a "pre-reversing angle of inclination θmin" (step S201). The pre-reversing actual height angle of inclination θh is a value stored in the memory 82 in step S15 described above.

Next, the acceleration αh of the auger housing 21 in the height direction is read (step S202). To read this acceleration αh in the height direction, a detection value detected by the acceleration sensor 83 is preferably read.

Figure 7:
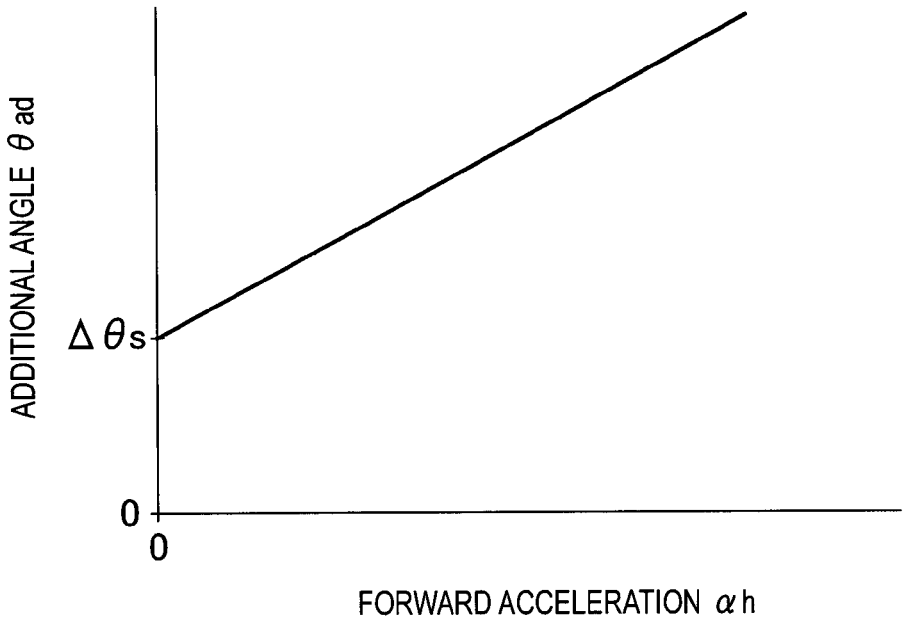
FIG. 7 is a map for determining an additional angle from forward acceleration in step S203 shown in FIG. 6.

Next, an additional angle θad is determined from the value of the acceleration αh in step S203. This additional angle θad is determined by the map shown in FIG. 7, for example. FIG. 7 shows a map for determining the additional angle θad relative to the acceleration αh, where the horizontal axis represents the forward acceleration αh of the travel device 14, and the vertical axis represents the additional angle θad. The characteristic of the additional angle θad relative to the acceleration αh is for example, a straight linear characteristic, such that the additional angle θad increases as the forward acceleration αh increases. This characteristic is such that the additional angle θad is set to be a minimum value Δθs when the acceleration αh is zero.

Next, the angle of inclination θh of the auger housing 21 in the height direction (the actual height angle of inclination θh) is determined from the acceleration ah in step S204 shown in FIG. 6. The method for determining the actual height angle of inclination θh on the basis of the actual acceleration αh is the same as in step S12 described above (see FIG. 4). The filter function and the zero point correction are also the same as in step S12 described above.

Next, an intermediate lowering target angle of inclination θm is determined (step S205). The intermediate lowering target angle of inclination θm is the value of the additional angle θad added to the pre-reversing angle of inclination θmin (θm=θmin+θad). In other words, the intermediate lowering target angle of inclination θm is an angle of the auger housing 21 midway through lowering from the reversing height upper limit angle βhu to the pre-reversing angle of inclination θh (the actual height angle of inclination θh), and is set according to the forward acceleration αh.

Next, an assessment of whether or not to execute auto height-down control is made in step S206. Specifically, it is assessed that auto height-down control will be executed when the following five conditions are all satisfied. The first condition is that the main switch 71 be on. The second condition is that the clutch lever switch 62*a* be on (that the travel preparatory lever 62 be gripped). The third condition is that the auto height switch 78 be on. The fourth condition is that the auger clutch 31 be on. The fifth condition is that the auger assist switch 79 be on.

When it is assessed in step S206 that this control will not be executed, the raising/lowering drive mechanism 18 is stopped and the lowering of the auger housing 21 is stopped (step S216) by turning off the lowering switch element 95, after which the subroutine is ended and the flow advances to step S24 shown in FIG. 4 described above. When it is assessed in step S206 that this control will be executed, the flow advances to step S207.

In step S207, the actual height angle of inclination θh is contrasted with the intermediate lowering target angle of inclination θm and the pre-reversing angle of inclination θmin.

Steps S208 to S210 are repeated while the actual height angle of inclination θh is assessed to be greater than the intermediate lowering target angle of inclination θm in step S207. In other words, the raising/lowering drive mechanism 18 is controlled so as to lower the auger housing 21 at a given lowering speed Sc while the actual height angle of inclination θh is within a range from the reversing height upper limit angle βhu to the intermediate lowering target angle of inclination θm.

More specifically, first, the lowering switch element 95 is turned on and the electric motor 18*a* is caused to rotate forward at a given rotational speed in step S208. As a result, the auger housing 21 is lowered at a given lowering speed Sc. It is preferable for the value of the lowering speed Sc to be high in order for the auger housing 21 to be lowered quickly.

Next, the acceleration αh of the auger housing 21 in the height direction is read (step S209). To read the acceleration αh in the height direction, a detection value detected by the acceleration sensor 83 is preferably read.

Next, in step S210, the height angle of inclination θh of the auger housing 21 in the height direction (the actual height angle of inclination θh) is determined from the acceleration αh, after which the flow returns to step S206. The method for determining the actual height angle of inclination θh on the basis of the actual acceleration αh is the same as in step S12 described above (see FIG. 4). The filter function and the zero point correction are also the same as in step S12 described above.

Steps S211 to S215 are repeated while the actual height angle of inclination θh is assessed in step S207 to be equal to or less than the intermediate lowering target angle of inclination θm and greater than the pre-reversing angle of inclination θmin. In other words, the raising/lowering drive mechanism 18 is controlled so as to lower the auger housing 21 at a gradually decreasing lowering speed Sv while the actual height angle of inclination θh is within a range from the intermediate lowering target angle of inclination θm to the pre-reversing angle of inclination θmin.

More specifically, first, the absolute value of the difference between the pre-reversing angle of inclination θmin and the actual height angle of inclination θh, i.e. the deviation of the actual height angle of inclination θh from the pre-reversing angle of inclination θmin, is set to Δθ in step S211.

Figure 8:
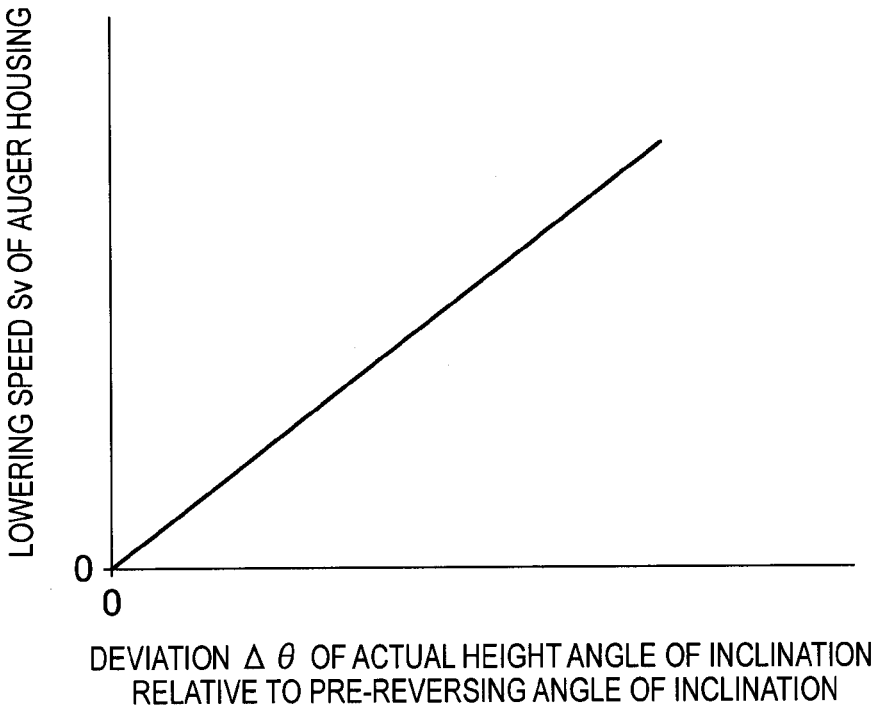
FIG. 8 is a map for determining a speed at which the auger housing is lowered from the deviation of the actual height incline angle of inclination relative to the pre-reversing angle of inclination in step S211 shown in FIG. 6.

Next, the lowering speed Sv of the auger housing 21 is determined from the deviation Δθ (step S212). The lowering speed Sv is determined by the map shown in FIG. 8, for example. FIG. 8 shows a map for determining the lowering speed Sv relative to the deviation Δθ, wherein the horizontal axis represents the deviation Δθ and the vertical axis represents the lowering speed Sv of the auger housing 21. The characteristic of the lowering speed Sv relative to the deviation Δθ is a straight linear characteristic, for example, such that the lowering speed Sv decreases as the actual height angle of inclination θh approaches the pre-reversing angle of inclination θmin. The lowering speed Sv is set to be zero when the deviation Δθ is zero, for example. The maximum value of the lowering speed Sv is set to be either equal to or less than the given lowering speed Sc. Therefore, it is possible for there to be a smooth transition from the given lowering speed Sc to the gradually decreasing lowering speed Sv.

Next, in step S213 shown in FIG. 6, the lowering switch element 95 is turned on and the electric motor 18*a* is rotated forward at the decreased rotational speed. As a result, the auger housing 21 is lowered at the gradually decreasing lowering speed Sv.

Next, the acceleration αh of the auger housing 21 in the height direction is read (step S214). To read the acceleration αh in the height direction, a detection value detected by the acceleration sensor 83 is preferably read.

Next, after the angle of inclination θh of the auger housing 21 in the height direction (the actual height angle of inclination θh) is determined from the acceleration αh in step S215, the flow returns to step S206. The method for determining the actual height angle of inclination θh on the basis of the actual acceleration αh is the same as in step S12 described above (see FIG. 4). The filter function and the zero point correction are also the same as in step S12 described above.

When it is assessed in step S207 described above that the actual height angle of inclination θh has fallen to the pre-reversing angle of inclination θmin, the raising/lowering drive mechanism 18 is stopped and the lowering of the auger housing 21 is stopped (step S216) by turning off the lowering switch element 95, after which the subroutine is ended and the flow advances to step S24 shown in FIG. 4 described above.

The above description is summarized as follows. As shown in FIG. 9A, the auger housing 21 rises when the travel device 14 is reversing (traveling in the direction of the white arrow Ba). The angle of inclination of the auger housing 21 immediately before the travel device 14 reverses is θmin. A state in which the auger housing 21 has risen to the predetermined upper limit angle βhu is shown in FIG. 9B. This action is performed by the control unit 81 (see FIG. 2) executing steps S21 to S23 shown in FIG. 4.

As shown in FIG. 9B, when the travel device 14 begins to move forward (travel in the direction of the white arrow Fw) after having temporarily moved in reverse, the auger housing 21 lowers from the upper limit angle βhu to the pre-reversing angle of inclination θmin.

In this case, first, the auger housing 21 lowers at the given lowering speed Sc from the reversing height upper limit angle βhu to the intermediate lowering target angle of inclination θm. Next, the auger housing 21 lowers at a gradually decreasing lowering speed Sv from the intermediate lowering target angle of inclination θm to the pre-reversing angle of inclination θmin. This series of actions is performed by the control unit 81 (see FIG. 2) executing steps S21, S22, and S24 shown in FIG. 4.

Herein is a description of the reasons for setting the intermediate lowering target angle of inclination θm which is the additional angle θad added to the pre-reversing angle of inclination θmin, and for changing the speed at which the auger housing is lowered 21 above and below the intermediate lowering target angle of inclination θm.

Snow plowing performance is excellent because the pre-reversing angle of inclination θmin is reached sooner if the auger housing 21 is lowered at a high speed. However, a higher forward travel speed of the travel device 14 corresponds to greater acceleration αh of the auger housing 21. Therefore, when the auger housing 21 is simply lowered at a certain high speed, the auger housing 21 might go below the pre-reversing angle of inclination θmin due to the effect of its own acceleration αh.

The possibility is then considered of lowering the auger housing 21 at a high speed when the auger housing is far from the pre-reversing angle of inclination θmin, and lowering the auger housing at a low speed when the auger housing is near the pre-reversing angle of inclination θmin. As a result, the auger housing 21 can be precisely stopped at the position of the pre-reversing angle of inclination θmin. However, it takes time for the auger housing 21 to lower from the upper limit angle βhu to the pre-reversing angle of inclination θmin. Therefore, depending on the forward traveling speed of the travel device 14, the auger housing 21 could touch the piles of snow accumulated in front before the auger housing 21 has fully lowered. In this case, there is much unevenness in the surface of the remaining snow that could not be fully removed. There is yet room for improvement in neatly removing snow as quickly as possible.

In the present embodiment, the intermediate lowering target angle of inclination θm is set in relation to the pre-reversing angle of inclination θmin. Moreover, the speed at which the auger housing is lowered 21 is changed above and below the intermediate lowering target angle of inclination θm. When the auger housing 21 is above the intermediate lowering target angle of inclination θm, the auger housing can be quickly lowered to the intermediate lowering target angle of inclination θm by being lowered at the given lowering speed Sc. The lowering speed Sv is thereafter gradually reduced (assist control) when the auger housing 21 is below the intermediate lowering target angle of inclination θm. As a result, the auger housing 21 can be stopped with precision at the position of the pre-reversing angle of inclination θmin.

Moreover, the intermediate lowering target angle of inclination θm is determined by determining the additional angle θad from the value of the forward acceleration αh. The higher the forward travel speed of the travel device 14, the greater the increase in the acceleration αh of the auger housing 21. To adapt to this, the greater the acceleration αh, the greater the additional angle θad relative to the position of the pre-reversing angle of inclination θmin. As a result, it is possible to prevent the auger housing 21 from going below the pre-reversing angle of inclination θmin due to the effect of its own acceleration αh.

Thus, in the present embodiment, the auger housing 21 can be stopped quickly and precisely at the position of the pre-reversing angle of inclination θmin while the effect of the acceleration αh of the auger housing 21, caused by the forward travel speed of the travel device 14, is eliminated as much as possible.

In the present invention, the control unit 81 includes a configuration for controlling the auger housing 21 so that the auger housing temporarily stops at the point in time when the auger housing has lowered from the reversing height upper limit angle βhu to the intermediate lowering target angle of inclination θm, and thereafter lowers from the intermediate lowering target angle of inclination θm to the pre-reversing angle of inclination θmin, in the control flow shown in FIG. 6.

When executing step S103 of the control flow shown in FIG. 5, the control unit 81 may raise the auger housing 21 at two levels of speed, similar to steps S211 to S212 shown in FIG. 6. In other words, the control unit 81 includes a configuration such that the auger housing 21 rises at a gradually decreasing speed as it approaches the reversing height upper limit angle βhu.

The control unit 81 also includes a configuration for executing rolling control of the auger housing 21 simultaneously with the auto height mode control shown in FIG. 4.

The snow plow 10 of the present invention is suitable as an auger snow plow in which at least an auger 23 is driven by an engine 15.

Obviously, various minor changes and modifications of the present invention are possible in light of the above teaching. It is therefore to be understood that within the scope of the appended claims the invention may be practiced otherwise than as specifically described.

What is claimed is:

1. A snow plow comprising a travel frame having a travel device, an auger housing having an auger and capable of being raised and lowered relative to the travel frame, a raising/lowering drive mechanism for raising and lowering the auger housing, and a control unit for controlling the raising/lowering drive mechanism so as to raise the auger housing to a predetermined upper limit angle when the travel device is reversing, wherein the snow plow further includes an acceleration sensor for detecting acceleration produced in the auger housing, the control unit determines an angle of inclination of the auger housing on a basis of the acceleration detected by the acceleration sensor, and when a condition is satisfied that the travel device starts moving forward after having temporarily moved in reverse, the control unit:

sets an intermediate lowering target angle of inclination, which is in a lowering path of the auger housing from the upper limit angle to a pre-reversing angle of inclination, in accordance with a forward acceleration, controls the raising/lowering drive mechanism so that the auger housing is lowered at a given lowering speed from the upper limit angle to the intermediate lowering target angle of inclination; and controls the raising/lowering drive mechanism so that the auger housing is lowered at a gradually decreasing lowering speed from the intermediate lowering target angle of inclination to the pre-reversing angle of inclination.

* * * * *